US010443845B2

(12) United States Patent
Numata et al.

(10) Patent No.: US 10,443,845 B2
(45) Date of Patent: Oct. 15, 2019

(54) GAS TURBINE COMBUSTOR

(71) Applicant: MITSUBISHI HITACHI POWER SYSTEMS, LTD., Yokohama (JP)

(72) Inventors: Shohei Numata, Yokohama (JP); Osami Yokota, Yokohama (JP); Tetsuma Tatsumi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 597 days.

(21) Appl. No.: 14/845,600

(22) Filed: Sep. 4, 2015

(65) Prior Publication Data

US 2016/0069566 A1 Mar. 10, 2016

(30) Foreign Application Priority Data

Sep. 5, 2014 (JP) ..... 2014-180901

(51) Int. Cl.
*F23R 3/02* (2006.01)
*F23R 3/00* (2006.01)
(Continued)

(52) U.S. Cl.
CPC ..... *F23R 3/002* (2013.01); *F23R 3/005* (2013.01); *F23R 3/12* (2013.01); *F23R 3/60* (2013.01); *F23R 2900/03045* (2013.01)

(58) Field of Classification Search
CPC .. F23R 3/54; F23R 3/002; F23R 3/005; F23R 3/04; F23R 2900/03043; F23R 2900/03045; F05D 2260/2212–22141
See application file for complete search history.

(56) References Cited

U.S. PATENT DOCUMENTS 5,426,943 A 6/1995 Althaus et al.
7,080,515 B2 * 7/2006 Wasif ..... F23R 3/14 60/737
(Continued)

FOREIGN PATENT DOCUMENTS

CN 101349425 A 1/2009
CN 102853450 A 1/2013
(Continued)

OTHER PUBLICATIONS

Extended European Search Report received in corresponding European Application No. 15182855.5 dated Jan. 14, 2016.
(Continued)

*Primary Examiner* — Gerald L Sung
*Assistant Examiner* — Rene D Ford
(74) *Attorney, Agent, or Firm* — Mattingly & Malur, PC

(57) ABSTRACT

A gas turbine combustor includes a combustor liner, a flow sleeve in which the combustor liner is provided and an annular flow passage formed between the combustor liner and the flow sleeve, through which compressed air flows. The flow sleeve includes an internal-diameter changing portion diagonally connected to the flow sleeve and an internal-diameter reducing portion connected to the internal-diameter changing portion and extending along the flow direction of the compressed air. The combustor liner includes an annular protruding portion annularly formed on an outer wall of the combustor liner and protruding toward the flow sleeve. The annular protruding portion is located at a position on the outer wall of the combustion liner, the position facing a connection position between the flow sleeve and the internal-diameter changing portion or being at an upstream side of the position facing the connection position in the flow direction of the compressed air.

12 Claims, 7 Drawing Sheets

(51) Int. Cl.
*F23R 3/60* (2006.01)
*F23R 3/12* (2006.01)

(56) References Cited

U.S. PATENT DOCUMENTS

| | | | | |
|---|---|---|---|---|
| 8,201,412 | B2 | 6/2012 | Dugar et al. | |
| 8,245,513 | B2 * | 8/2012 | Huth | F23R 3/005 60/752 |
| 8,413,445 | B2 * | 4/2013 | Poyyapakkam | F23D 14/70 60/737 |
| 2002/0005274 | A1 | 1/2002 | Beeck et al. | |
| 2008/0256956 | A1 | 10/2008 | Poyyapakkam | |
| 2009/0019854 | A1 | 1/2009 | Simons et al. | |
| 2011/0203287 | A1 | 8/2011 | Chila et al. | |
| 2013/0160423 | A1 * | 6/2013 | Wasif | F23R 3/26 60/39.23 |
| 2014/0230442 | A1 | 8/2014 | Yokota et al. | |

FOREIGN PATENT DOCUMENTS

| | | | |
|---|---|---|---|
| CN | 103032896 | A | 4/2013 |
| CN | 103994468 | A | 8/2014 |
| DE | 10 2008 002 931 | A1 | 1/2009 |
| EP | 1 114 976 | A2 | 7/2001 |
| EP | 2 541 146 | A2 | 1/2013 |
| EP | 2 770 258 | A2 | 8/2014 |
| JP | 6-221562 | A | 8/1994 |
| JP | 8-270947 | A | 10/1996 |
| JP | 2000-320837 | A | 11/2000 |
| JP | 2001-280154 | A | 10/2001 |
| JP | 2008-267799 | A | 11/2008 |

OTHER PUBLICATIONS

Japanese Office Action received in corresponding Japanese Application No. 2014-180901 dated Oct. 3, 2017.
Chinese Office Action received in corresponding Chinese Application No. 201510548421.1 dated Jun. 26, 2017.
Chinese Office Action received in corresponding Chinese Application No. 201510548421.2 dated Mar. 9, 2018.

* cited by examiner

GAS TURBINE COMBUSTOR

CLAIM OF PRIORITY

The present application claims priority from Japanese Patent Application JP 2014-180901 filed on Sep. 5, 2014, the content of which is hereby incorporated by reference into this application.

FIELD OF THE INVENTION

The present invention relates to a gas turbine combustor, specifically relates to a gas turbine combustor equipped with a cooling component.

BACKGROUND OF THE INVENTION

The equipment for the gas turbine such as the combustor liner, turbine blade, heat exchanger, fin, boiler, and heating furnace has been designed to be variously configured based on the specification required to satisfy the heat transfer enhancement between fluid and solid in the processes of cooling, heating and heat exchange. For example, the combustor used in the gas turbine for generation is required to maintain necessary cooling performance with small pressure loss not to deteriorate the gas turbine efficiency as well as to maintain reliability in the structural strength.

Furthermore, reduction in emission of nitrogen oxide (NOx) generated in the combustor is demanded to cope with environmental issues. Generation of NOx may be attributed to the fact that oxygen and nitrogen contained in air are kept at the significantly high temperature during combustion. In order to reduce the NOx by solving the above-described problem, the premixed combustion is implemented by mixing the fuel and air before combustion and combusting the mixture at the fuel-air mixture ratio (fuel-air ratio) lower than the stoichiometric ratio.

JP 2001-280154 discloses an example of the gas turbine combustor in consideration of the aforementioned requirements. According to JP 2001-280154, the plate-like longitudinal vortex generator and the rib-like turbulator are formed on the outer surface of the combustor liner to improve the cooling performance with small pressure loss. The gas turbine combustor in JP 2001-280154 includes a liner formed by axially connecting plural cylindrical members each derived from rounding substantially rectangular plate material into a cylindrical shape. The respective cylindrical members of the liner are connected with one another in the state where the adjacent cylindrical members are overlapped. The overlapped parts are bonded by welding. One end (downstream side in the flow direction of the compressed air from the compressor) of the cylindrical member is provided with plural protruding portions (longitudinal vortex generator) formed through press machining along the circumferential direction. The longitudinal vortex generator generates the longitudinal vortex having the center axis of rotation directed to the flow of the heat transfer medium (the compressed air) to agitate the flow passage of the heat transfer medium by the longitudinal vortex. Furthermore, the outer peripheral surface of the combustor liner is provided with a rib (turbulator) for destroying the boundary layer generated in the heat transfer medium agitated by the longitudinal vortex generator. The rib is formed through machining, welding or centrifugal casting.

JP 6-221562 discloses a gas turbine combustor as another example of the heat transfer structure, which includes a flow sleeve (outer duct) outside the liner for the purpose of forming the flow passage of the cooling air (heat transfer medium). The internal diameter of the flow sleeve is gradually reduced along the flow direction of the heat transfer medium. The gas turbine combustor in JP 6-221562 is configured to increase the flow velocity of the heat transfer medium by narrowing the flow passage of the heat transfer medium between the liner and the flow sleeve, and to improve the heat transfer coefficient by increasing the surface roughness of the liner surface.

JP 2000-320837 discloses a gas turbine combustor as another example of the heat transfer structure, which includes guide fins at the outer peripheral side of the liner and the inner peripheral side of the flow sleeve so that the heat transfer effect is improved by increasing the flow velocity of the compressed air (heat transfer medium). The gas turbine combustor in JP 2000-320837 is configured to reduce the cross section area of the annular flow passage formed between the combustor liner and the flow sleeve by the guide fins to improve the heat transfer effect by increasing the flow velocity of the heat transfer medium flowing through the annular flow passage.

The gas turbine combustor disclosed in JP 2001-280154 is superior to conventional combustors in the cooling performance and low NOx, but still has a problem to be solved with respect to the structural strength, simplicity in the manufacturing process, and the long service life. For example, the combustor liner is formed by connecting plural cylindrical members in an axial direction and the overlapped parts between the cylindrical members are bonded by welding, which may cause cracks and impede the long-term use compared with the case where the welding is not applied (that is, the single cylindrical member is used for forming the liner). As the number of the welded points is increased, the number of the manufacturing process steps is also increased, thus leading to the manufacturing cost increase. This may become more marked when the rib as the turbulator is fixed by welding. Furthermore, the welding will thermally deform the respective cylindrical members, deteriorating the incorporation of other circular members (for example, a circular plate to which the fuel nozzle or the premixing nozzle is attached, and the transition piece (tail duct)) into the combustor liner, which necessitates a process for forming the liner into the circular shape again. This may cause the risk of complicating the process for manufacturing the combustor. The overlapped part between the respective cylindrical members for forming the liner has a two-layer structure with thickness larger than that of the other part. This may degrade the heat transfer performance (coolability) of the overlapped part compared with the other part.

The gas turbine combustor disclosed in JP 6-221562 has a simply structured liner compared with the gas turbine combustor in JP 2001-280154. It is therefore superior in simplicity of the manufacturing process and the long service life. The heat transfer performance of the combustor of JP 6-221562 is enhanced only by increasing the flow velocity of the heat transfer medium and the surface roughness of the liner surface. As a result, the combustor of JP 6-221562 has a problem to be solved that the pressure loss is inevitably increased to obtain significantly high heat transfer enhancing effect (cooling effect). As the flow passage for the cooling air is gradually narrowed toward the burner, the highest cooling effect is obtained near the burner. If high temperature section of the combustor liner is located at a position away from the burner, the combustor of JP 6-221562 cannot cool the high temperature section sufficiently.

The gas turbine combustor disclosed in JP 2000-320837, having a guide fin disposed at the inner peripheral side of the flow sleeve, is superior in simplicity and long service life. However, the heat transfer (cooling) performance is enhanced only by increasing the flow velocity of the heat transfer medium. Therefore, the combustor of JP 2000-320837 has a problem that the pressure loss is inevitably increased to obtain significantly great effect of enhancing the heat transfer, just like the combustor of JP 6-221562.

An object of the present invention is to provide a gas turbine combustor configured to enhance the cooling of the combustor liner with suppressing increase in the pressure loss, and to have advantageous effects of excelling in the structural strength, simplicity of the manufacturing process, and long service life.

SUMMARY OF THE INVENTION

A gas turbine combustor according to the present invention comprises a combustor liner as an inner duct, a flow sleeve as an outer duct, in which the combustor liner is provided, and an annular flow passage formed between the combustor liner and the flow sleeve, through which compressed air flows. The flow sleeve includes a narrowing member formed on an inner wall of the flow sleeve, the narrowing member protruding toward the combustor liner. The combustor liner includes an annular protruding portion annularly formed on an outer wall of the combustor liner, the annular protruding portion protruding toward the flow sleeve. The narrowing member includes an internal-diameter changing portion and an internal-diameter reducing portion. The internal-diameter changing portion is a plane diagonally connected to the flow sleeve to gradually approach the combustor liner as the internal-diameter changing portion extends in a flow direction of the compressed air. The internal-diameter reducing portion is a plane disposed at a downstream side of the internal-diameter changing portion in the flow direction of the compressed air, connected to the internal-diameter changing portion, and extending along the flow direction of the compressed air The annular protruding portion is located at a position on the outer wall of the combustion liner, the position facing a connection position between the flow sleeve and the internal-diameter changing portion or being at an upstream side of the position facing the connection position in the flow direction of the compressed air.

A gas turbine combustor of the present invention can enhance the cooling of the combustor liner with suppressing increase in the pressure loss, and has advantageous effects of excelling in the structural strength, simplicity of the manufacturing process, and long service life.

DETAILED DESCRIPTION OF THE PREFERRED EMBODIMENTS

Figure 1:
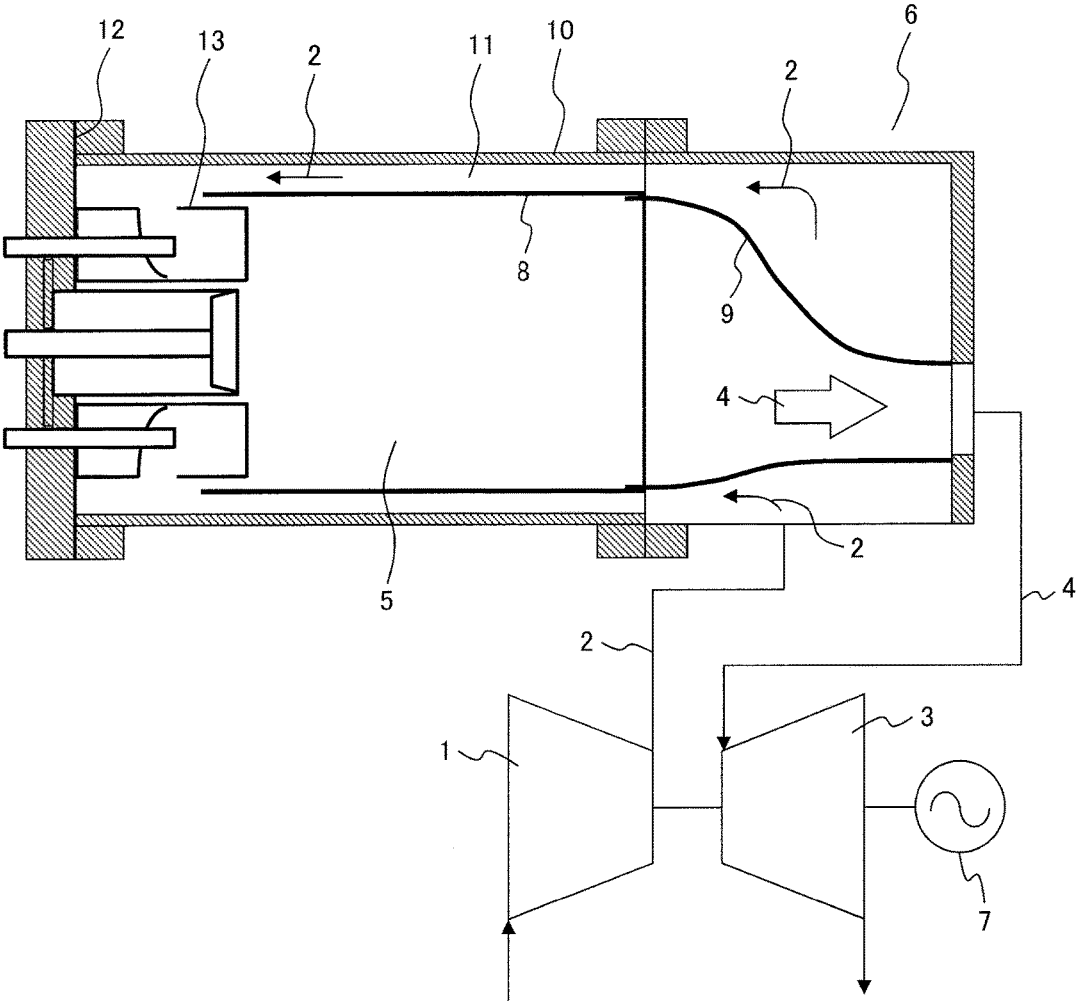
FIG. 1 is a sectional view of a gas turbine combustor according to an embodiment of the present invention, schematically showing a configuration of a gas turbine plant.

A gas turbine combustor according to the embodiments of the present invention is equipped with cooling component and enhances cooling of the member (combustor liner) by enhancing the heat transfer between the member and the fluid (heat transfer medium) through forced convection, that is, by making the heat transfer medium flow along the surface of the member to exchange the heat between the member and the heat transfer medium.

Improvement of thermal power generation efficiency using the gas turbine needs to attain high combustion gas temperature. It is therefore necessary to enhance cooling of the combustor liner. At the same time, increased pressure loss of the gas turbine combustor leads to deterioration in the gas turbine efficiency, which has to be avoided. In the aforementioned circumstances, increase in the jet flow velocity for enhancing the cooling performance in the process of impinging jet cooling (impingement cooling) may be the significant cause of the pressure loss. In the fin cooling, the pressure loss tends to become larger as the number of fins is increased. Promotion of turbulence by the ribs results in small increase in the pressure loss. However, the cooling enhancement by increasing the number of ribs has a limitation since marked improvement in the cooling performance cannot be expected even if the interval of the ribs is narrowed.

The present invention provides a gas turbine combustor configured to enhance cooling of the combustor liner with suppressing increase in the pressure loss, and to excel in the structural strength, simplicity of the manufacturing process, and long service life to improve the product reliability.

The gas turbine combustor according to the present invention includes a combustor liner, a flow sleeve provided with the combustor liner disposed therein, and an annular flow passage formed between the combustor liner and the flow sleeve, through which the compressed air (heat transfer medium) flows. The flow sleeve is provided with an internal-diameter changing portion which changes the internal diameter of the flow sleeve to be reduced. The combustor liner includes an annular protruding portion protruding toward the flow sleeve, which is located at a position where the flow direction of the compressed air is changed by the internal-diameter changing portion or at a position upstream of the aforementioned position (where the flow direction of the compressed air is changed) in the flow direction of the compressed air.

The gas turbine combustor according to the present invention has the flow sleeve provided with the internal-diameter changing portion so that the flow direction of the heat transfer medium is changed to increase the flow velocity, and has the combustor liner provided with the annular protruding portion so that the heat transfer effect is enhanced. With this configuration, the gas turbine combustor of the present invention can enhance the convective cooling (cooling by convective heat transfer) of the combustor liner with the simple structure and small pressure loss and can improve the product reliability. By adjusting configurations and positions for disposing the internal-diameter changing portion and the annular protruding portion, it is possible to intensively cool the high temperature section of the combustor liner and suppress the temperature of the combustor liner below the predetermined value. The number of parts to be provided for the combustor liner is reduced to decrease the number of welding points. This makes it possible to improve the reliability of the combustor liner, accompanying long service life. Decrease in the number of the welding points may suppress deformation of the combustor liner. Furthermore, setting of the height of the annular protruding portion (protruding length) to the predetermined value or larger improves buckling strength of the combustor liner, contributing to improvement of the product reliability.

Gas turbine combustors according to embodiments of the present invention will be described referring to the drawings. In the drawings, the same element will be designated with the same reference character, and the repetitive explanation thereof will be omitted. In the following description, the terms "gas turbine combustor", the "combustor liner", and the "gas turbine" will be referred to as the "combustor", "liner", and "turbine", respectively.

FIG. 1 is a sectional view of a gas turbine combustor according to an embodiment of the present invention, schematically showing a configuration of a gas turbine plant (gas turbine generating facility) provided with the gas turbine combustor. The gas turbine plant includes a compressor 1, a gas turbine combustor 6, a gas turbine 3, and a generator 7.

The compressor 1 generates high-pressure combustion air (compressed air 2) through air compression. The gas turbine combustor 6 (combustor 6) mixes the fuel and the compressed air 2 introduced from the compressor 1 for combustion to generate high-temperature combustion gas 4. The gas turbine 3 (turbine 3) obtains the axial driving force from energy of the combustion gas 4 generated by the combustor 6. The generator 7 is driven by the turbine 3 to generate power. The respective rotary shafts of the compressor 1, the turbine 3, and the generator 7 are mechanically linked with one another.

The combustor 6 includes a flow sleeve (outer duct) 10, a combustor liner (inner duct) 8, a combustion chamber 5, a transition piece (tail duct) 9, an annular flow passage 11, a plate 12, and plural burners 13.

The flow sleeve 10 is a cylindrical structure provided with the combustor liner 8 and the transition piece 9 disposed therein, and adjusts the flow velocity and drift of the compressed air 2 supplied into the combustor 6. The combustor liner 8 (liner 8) is a cylindrical structure, which is provided inside the flow sleeve 10 with being spaced from the flow sleeve 10. The combustion chamber 5 is formed inside the liner 8. The transition piece 9 is a tubular structure, which is provided inside the flow sleeve 10 with being spaced from the flow sleeve 10 and connected to an opening of the liner 8 closer to the turbine 3 so that the combustion gas 4 generated in the combustion chamber 5 is guided into the turbine 3. The annular flow passage 11 is formed between the transition piece 9 and the flow sleeve 10 and between the liner 8 and the flow sleeve 10 to allow the compressed air 2 supplied from the compressor 1 to flow into the combustion chamber 5. The compressed air 2 also functions as the heat transfer medium for cooling the liner 8. The transition piece 9 is connected to the liner 8 at the upstream side of the liner 8 in the flow direction of the compressed air 2 from the compressor 1.

The plate 12 has a substantially circular plate-like shape, with one end surface facing the combustion chamber 5 to completely cover the end of the liner 8 at the upstream side in the flow direction of the combustion gas 4, and is attached to the flow sleeve 10 to be substantially perpendicular to the center axis of the liner 8. The burners 13 are disposed on the plate 12.

Descriptions will be omitted in the embodiments below for the general structure of the turbine 3 and the detailed function of the combustor 6 including the fuel nozzles. Refer to JP 2001-280154, for example, for descriptions for these components.

First Embodiment

Figure 2:
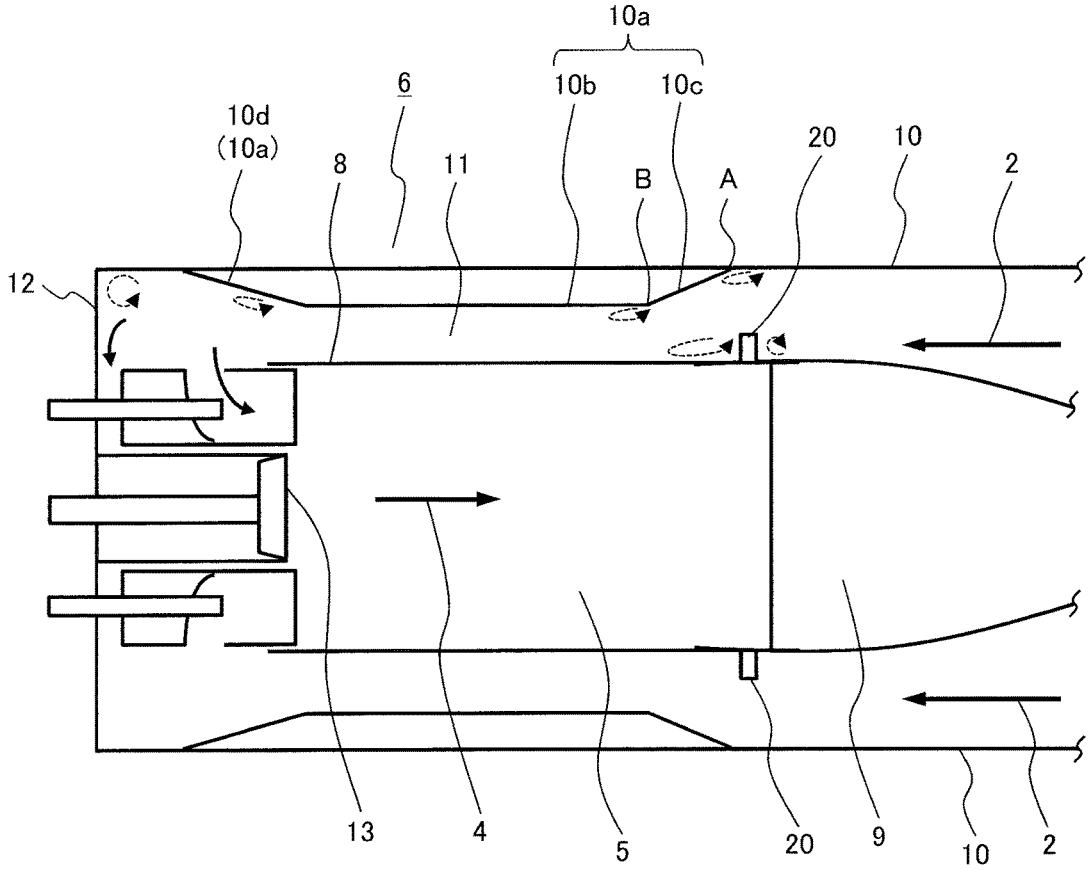
FIG. 2 is a sectional view of the gas turbine combustor according to a first embodiment of the present invention.

FIG. 2 is a sectional view of the gas turbine combustor 6 according to a first embodiment of the present invention. The combustor liner 8 and the flow sleeve 10 constitute a substantially coaxial double cylindrical structure. The diameter of the flow sleeve 10 is larger than that of the combustor liner 8 so that the annular flow passage 11 is formed between the flow sleeve 10 and the combustor liner 8. The compressed air 2 as the heat transfer medium flows through the annular flow passage 11.

The flow sleeve 10 includes a narrowing member 10*a* which is disposed on the inner wall of the flow sleeve 10 and protrudes toward the combustor liner 8 for changing the internal diameter of the flow sleeve 10 to be reduced. The narrowing member 10*a* is a structure for narrowing the annular flow passage 11 and includes an internal-diameter changing portion 10*c* and an internal-diameter reducing portion 10*b*. The internal-diameter changing portion 10*c* is a plane diagonally connected to the flow sleeve 10 to gradually approach the combustor liner 8 as the internal-diameter changing portion 10 extends in the flow direction of the compressed air 2. The internal-diameter reducing portion 10*b* is a plane disposed at the downstream side of the internal-diameter changing portion 10*c* in the flow direction of the compressed air 2, connected to the internal-diameter changing portion 10*c*, and extending along the flow direction of the compressed air 2. In the following description, the position at which the flow sleeve 10 and the internal-diameter changing portion 10*c* are connected to each other will be referred to as a connection position A, and the position at which the internal-diameter changing portion 10*c* and the internal-diameter reducing portion 10*b* are connected to each other will be referred to as a connection position B.

The annular flow passage 11 is gradually narrowed from the connection position A to the connection position B along the flow direction of the compressed air 2. The compressed air 2 then flows through the annular flow passage 11 narrowed by the narrowing member 10*a* (through the spaces between the internal-diameter changing portion 10*c* and the combustor liner 8 and between the internal-diameter reducing portion 10*b* and the combustor liner 8).

As FIG. 2 shows, the narrowing member 10*a* may be configured to have a downstream internal-diameter changing portion 10*d*. The downstream internal-diameter changing portion 10*d* is connected to the internal-diameter reducing portion 10*b* at the downstream side in the flow direction of the compressed air 2 and diagonally connected to the flow sleeve 10 to be gradually away from the combustor liner 8 along the flow direction of the compressed air 2. The downstream internal-diameter changing portion 10*d* is a plane for changing the internal diameter of the flow sleeve 10 to be gradually increased from the internal-diameter reducing portion 10*b*. The downstream internal-diameter changing portion 10*d* provides an effect for further suppressing increase in the pressure loss.

The combustor liner 8 includes an annular protruding portion 20 on the outer wall of the combustor liner 8. The annular protruding portion 20 is an annular member protruding toward the flow sleeve 10, and is located at a position facing the connection position A where the flow sleeve 10 and the internal-diameter changing portion 10*c* are connected to each other, in other words, at a position where the annular flow passage 11 is narrowed by the internal-diameter changing portion 10*c* so that the flow direction of the compressed air 2 is changed. Alternatively, the annular protruding portion 20 may be located at a position upstream of the aforementioned position (a position facing the connection position A) in the flow direction of the compressed air 2. The annular protruding portion 20 is annularly disposed on the outer wall of the combustor liner 8 to have functions for suppressing increase in the pressure loss of the gas turbine combustor 6 and enhancing cooling of the combustor liner 8 in addition to a function serving as a reinforcing material for maintaining the shape of the combustor liner 8.

The annular protruding portion 20 is disposed at a position around the high temperature section of the liner 8 or at a position at the upstream side of the high temperature section in the flow direction of the compressed air 2. The position of the high temperature section and the position at which the wall surface temperature of the liner 8 is maximized may be determined by the structure of the combustor 6 and preliminarily obtained by conducting a combustion test or simulation.

The connection position A between the flow sleeve 10 and the internal-diameter changing portion 10*c* may be determined based on the position of the annular protruding portion 20. As described above, the annular protruding portion 20 is located at a position facing the connection position A or a position upstream thereof in the flow direction of the compressed air 2. Therefore the connection position A is located at a position of the flow sleeve 10 facing the annular protruding portion 20 or a position downstream thereof in the flow direction of the compressed air 2. Setting of the connection position A and the annular protruding portion 20 in accordance with the aforementioned positional relationship may provide the effect for suppressing increase in the pressure loss.

Generally, the gas turbine combustor in which the compressed air 2 supplied from the compressor 1 flows through the annular flow passage 11 formed between the flow sleeve 10 and the liner 8 is configured to allow the compressed air 2 to flow through the annular flow passage 11 firstly to cool the liner 8 by the convective heat transfer. Thereafter, the compressed air 2 is mixed with the fuel in the burners 13, turned into the high temperature combustion gas 4 to flow in the combustion chamber 5. At this time, the combustion gas 4 heats the liner 8 by the convective heat transfer. The combustion gas 4 has a temperature distribution in the combustion chamber 5 under the influence of the reaction rate between the fuel and the compressed air 2 and the flow velocity distribution in the combustion chamber 5. Therefore, the liner 8 has a thermal dose distribution and then has a temperature distribution. As a result, a high temperature section is generated on the wall surface of the liner 8, which has a higher temperature than other sections of the wall surface have. Meanwhile, the maximum temperature of the liner 8 in operation is limited in accordance with the heat resistance of the metal material of the liner 8. Accordingly, the high temperature section is required to be efficiently cooled.

Generally, in the gas turbine combustor configured to allow the compressed air 2 to flow through the annular flow passage 11, the pressure loss is caused by separation vortex of the flow generated by expansion, reduction, and bending of the flow passage in addition to the frictional resistance between the compressed air 2 and the wall surface of the flow passage while the compressed air 2 flows through the annular flow passage 11, the burners 13, the combustion chamber 5, and the transition piece 9. Accordingly, generation of the separation vortex has to be minimized for lessening the pressure loss and improving the efficiency of the gas turbine 3.

The gas turbine combustor 6 according to this embodiment is capable of efficiently cooling the high temperature section of the liner 8 and reducing generation of the separation vortex by the narrowing member 10*a* (internal-diameter reducing portion 10*b* and the internal-diameter changing portion 10*c*) and the annular protruding portion 20. It is therefore possible to enhance the effect for cooling the liner 8 and to suppress increase in the pressure loss.

Figure 3A:
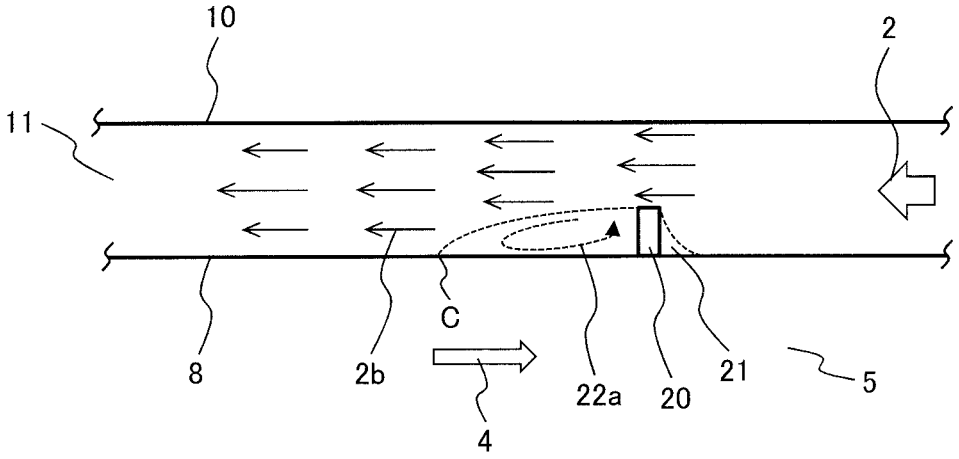
FIG. 3A is a schematic view of a part of an annular flow passage of a gas turbine combustor having a combustor liner provided with an annular protruding portion.
Figure 3B:
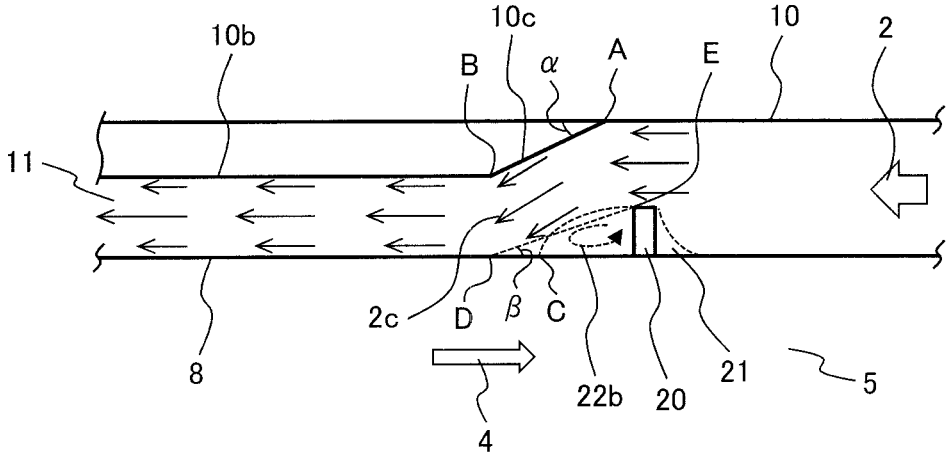
FIG. 3B is a schematic view of a part of an annular flow passage of a gas turbine combustor having a combustor liner provided with an annular protruding portion and a flow sleeve provided with an internal-diameter changing portion and an internal-diameter reducing portion.

FIGS. 3A and 3B are views describing a principle of enhancing cooling of the combustor liner 8 of the gas turbine 6 according to this embodiment, each of which is a sectional view in parallel with the center axis of the gas turbine combustor 6. FIGS. 3A and 3B schematically show a part of the annular flow passage 11 formed between the combustor liner 8 and the flow sleeve 10 in the gas turbine combustor 6. The compressed air 2 flows along the wall surfaces of the combustor liner 8 and the flow sleeve 10 through the annular flow passage 11. Referring to FIGS. 3A and 3B, the principle of enhancing cooling of the liner 8 will be described in the gas turbine combustor 6 according to this embodiment.

FIG. 3A is a schematic view of a part of the annular flow passage 11 of the gas turbine combustor having the combustor liner 8 provided with the annular protruding portion 20. The gas turbine combustor shown in FIG. 3A includes a flow sleeve 10 which does not have the internal-diameter changing portion 10*c* and the internal-diameter reducing portion 10*b*.

Referring to FIG. 3A, as the compressed air 2 flows through the annular passage 11, an upstream separation vortex 21 is generated at the upstream side of the annular protruding portion 20, and a downstream separation vortex 22*a* is generated at the downstream side. The upstream separation vortex 21 is small as it is pressed by the flow of the compressed air 2. Meanwhile, the downstream separation vortex 22*a* is largely extended by the flow of the compressed air 2. Typically, the length of the downstream separation vortex 22*a* in the flow direction of the compressed air 2 is approximately 6 to 8 times longer than the height of the annular protruding portion 20.

In the case of cooling the combustor liner 8 by the convective heat transfer, the flow velocity is substantially zero in the separation vortex area which is a retention region. In this region, substantially no cooling effect is derived from the compressed air 2. At an end point C (reattachment point C) of the separation vortex, as indicated by a flow velocity vector 2*b* of the compressed air 2, the thickness of the boundary layer around the wall surface of the combustor liner 8 is substantially zero and the cooling effect may be significantly enhanced. On the whole, the annular protruding portion 20 improves the heat transfer coefficient to a certain degree compared with the smooth flow passage having no annular protruding portion 20 but increases the pressure loss in accordance with the magnitude of the separation vortex.

FIG. 3B is a schematic view of a part of the annular flow passage 11 of the gas turbine combustor 6 having the combustor liner 8 provided with the annular protruding portion 20, and the flow sleeve 10 provided with the internal-diameter changing portion 10*c* and the internal-diameter reducing portion 10*b*. Referring to FIG. 3B, as the compressed air 2 flows through the annular flow passage 11, the upstream separation vortex 21 is generated at the upstream side of the annular protruding portion 20, and a downstream separation vortex 22*b* is generated at the downstream side, as described referring to FIG. 3A.

The length of the downstream separation vortex 22*b* is reduced in the flow direction of the compressed air 2 in comparison with the downstream separation vortex 22*a* shown in FIG. 3A. This is because a flow velocity vector 2*c* of the compressed air 2 (that is, flow direction of the compressed air 2) is bent by the internal-diameter changing portion 10*c* to be directed to the liner 8, and the outer flow of the downstream separation vortex 22*b* is bent to be directed to the liner 8 as well. In this case, the annular flow passage 11 is narrowed to increase the flow velocity of the compressed air 2, which will enhance the effect for changing the outer flow direction of the downstream separation vortex 22*b*.

The separation vortex region with low cooling effect is reduced in terms of cooling the combustor liner 8 by the convective heat transfer. The cooling effect at the end point C (reattachment point C) of the separation vortex is significantly enhanced along with the effect of promoting the convective cooling resulting from increased flow velocity of the compressed air 2. As the combustor liner 8 is formed of metal and exhibits high thermal conductivity, the temperature of the liner 8 is decreased in the region where the downstream separation vortex 22*b* is generated. Furthermore, if the annular protruding portion 20 is formed through machining to be integrated with the combustor liner 8, the temperature of the liner 8 is decreased by the fin effect in the region where the upstream separation vortex 21 is generated.

In order to efficiently cool the combustor liner 8 by the convective heat transfer, it is necessary to locate a position of the reattachment point C of the downstream separation vortex 22*b* or a position where the flow velocity of the compressed air 2 is increased at a position of the high temperature section of the liner 8 (preferably, a section where the temperature of the wall surface of the liner 8 is maximized) or a position upstream thereof in the flow direction of the compressed air 2. Accordingly, it is preferable to locate the annular protruding portion 20 at a position of the high temperature section of the liner 8 (preferably, a section where the temperature of the wall surface of the liner 8 is maximized) or a position upstream thereof in the flow direction of the compressed air 2. Preferably, the connection position A between the flow sleeve 10 and the internal-diameter changing portion 10*c* is located at a position of the flow sleeve 10 facing the annular protruding portion 20 or downstream thereof in the flow direction of the compressed air 2.

In the structure shown in FIG. 3B, the pressure loss is larger than that in the structure shown in FIG. 3A, which is caused by generation of the separation vortex both at the upstream and downstream sides in the flow direction of the compressed air 2 at the internal-diameter changing portion 10*c* of the flow sleeve 10 and by increase in the friction loss resulting from increase in the flow velocity of the compressed air 2 at the internal-diameter reducing portion 10*b*. However, as the length of the downstream separation vortex 22*b* is reduced, the increase in the pressure loss may be suppressed by configuring the internal-diameter changing portion 10*c* to suppress generation of the separation vortex. Specifically, it is possible to suppress generation of the separation vortex caused by the internal-diameter changing portion 10*c* as much as possible by forming the shapes of the connection part between the internal-diameter changing portion 10*c* and the flow sleeve 10 and the connection part between the internal-diameter changing portion 10*c* and the internal-diameter reducing portion 10*b* into smooth curves, or by setting the angle $\alpha$ formed between the internal-diameter changing portion 10*c* and the inner wall of the flow sleeve 10 to the appropriate value, as described later in other embodiments.

In terms of the structural strength, it is preferable to set the height (protruding length) of the annular protruding portion 20 to a value as large as possible for increasing the buckling strength. The preferable height of the annular protruding portion 20 may be obtained as below in consideration of the effect for enhancing the convective cooling by the downstream separation vortex 22*b* and the effect for suppressing increase in the pressure loss. Assuming that the position of the liner 8 facing the connection position B between the internal-diameter changing portion 10*c* and the internal-diameter reducing portion 10*b* is a position D, that the position of the top end portion of the annular protruding portion 20 at the downstream side in the flow direction of the compressed air 2 is a position E, and that an angle (minor angle) formed between the internal-diameter changing portion 10*c* and the inner wall of the flow sleeve 10 is $\alpha$, it is preferable to determine the height of the annular protruding portion 20 so that an angle $\mu$ (minor angle) formed between the straight line connecting the position D of the liner 8 with the position E of the annular protruding portion 20 and the outer wall of the liner 8 is equal to or smaller than the angle $\alpha$. It is more preferable to determine the height of the annular protruding portion 20 so that the angle $\mu$ is equal to or slightly smaller than the angle $\alpha$.

The protruding length of the narrowing member 10*a* (that is, the internal-diameter changing portion 10*c* and the internal-diameter reducing portion 10*b*) of the flow sleeve 10, which is directed to the combustor liner 8, may be arbitrarily determined depending on the height of the annular protruding portion 20 without specific limitation.

Second Embodiment

Figure 4:
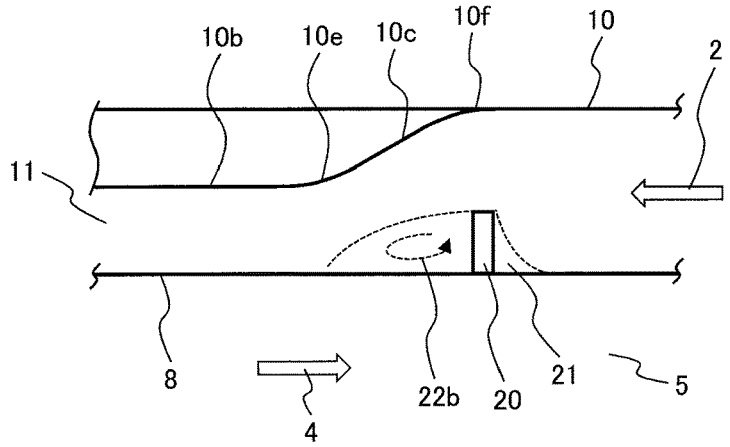
FIG. 4 is a schematic view of a part of the annular flow passage of the gas turbine combustor according to a second embodiment of the present invention, which is formed between the combustor liner and the flow sleeve.

FIG. 4 is a schematic view of a part of the annular flow passage 11 of the gas turbine combustor according to a second embodiment of the present invention, which is formed between the combustor liner 8 and the flow sleeve 10, illustrating a sectional view in parallel with the center axis of the gas turbine combustor. The features of the gas turbine combustor according to this embodiment will be described, which are different from those according to the first embodiment.

The gas turbine combustor according to this embodiment is configured so that the internal-diameter changing portion 10*c* of the flow sleeve 10 is smoothly connected both to the flow sleeve 10 and the internal-diameter reducing portion 10*b*. In other words, a connection portion 10*f* between the internal-diameter changing portion 10*c* and the flow sleeve 10 and a connection portion 10*e* between the internal-diameter changing portion 10*c* and the internal-diameter reducing portion 10*b* have smooth curve shapes. Preferably, the connection portions 10*f* and 10*e* have streamline shapes. The streamline-shaped connection portions 10*f* and 10*e* are capable of effectively suppressing generation of the separation vortex caused by the internal-diameter changing portion 10*c*.

The thus configured gas turbine combustor of this embodiment is capable of minimizing generation of the separation vortex while the compressed air 2 flows along the internal-diameter changing portion 10*c*, and suppressing increase in the pressure loss caused by the internal-diameter changing portion 10*c*.

Third Embodiment

Figure 5:
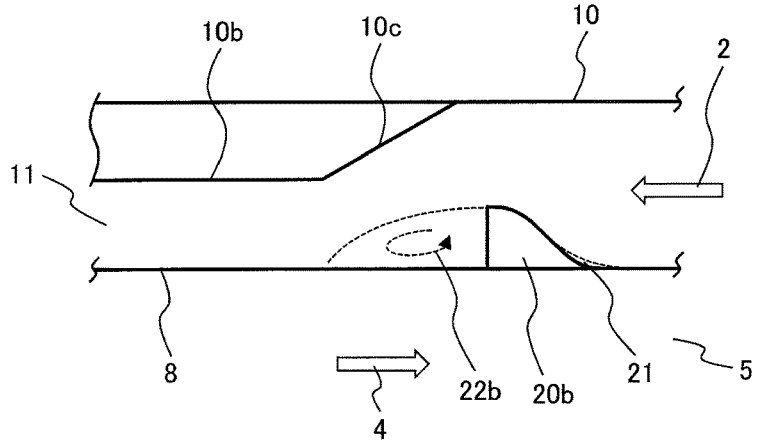
FIG. 5 is a schematic view of a part of the annular flow passage of the gas turbine combustor according to a third embodiment of the present invention, which is formed between the combustor liner and the flow sleeve.

FIG. 5 is a schematic view of a part of the annular flow passage 11 of the gas turbine combustor according to a third embodiment of the present invention, which is formed between the combustor liner 8 and the flow sleeve 10, illustrating a sectional view in parallel with the center axis of the gas turbine combustor. The features of the gas turbine combustor according to this embodiment will be described, which are different from those according to the first embodiment.

The gas turbine combustor according to this embodiment includes the combustor liner 8 having an annular protruding portion 20*b* on the outer wall of the combustor liner 8. The annular protruding portion 20*b* has a curved surface at the upstream side in the flow direction of the compressed air 2. Preferably, the curved surface of the annular protruding portion 20*b* has a streamline shape. Preferably, the connection portion between the curved surface and the outer wall of the combustor liner 8 has a smooth curved shape and is smoothly connected with the outer wall of the combustor liner 8. More preferably, the connection portion has a streamline shape.

The thus configured gas turbine combustor of this embodiment is capable of minimizing generation of the upstream separation vortex 21 while the compressed air 2 flows along the annular protruding portion 20*b*, and suppressing increase in the pressure loss caused by the annular protruding portion 20*b*.

Fourth Embodiment

Figure 6:
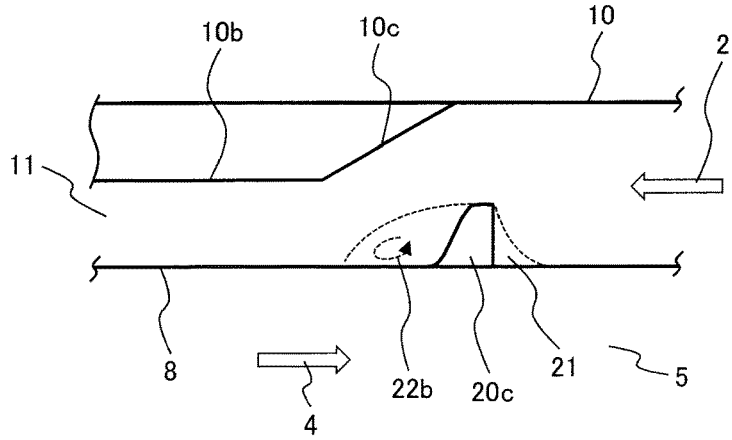
FIG. 6 is a schematic view of a part of the annular flow passage of the gas turbine combustor according to a fourth embodiment of the present invention, which is formed between the combustor liner and the flow sleeve.

FIG. 6 is a schematic view of a part of the annular flow passage 11 of the gas turbine combustor according to a fourth embodiment of the present invention, which is formed between the combustor liner 8 and the flow sleeve 10, illustrating a sectional view in parallel with the center axis of the gas turbine combustor. The features of the gas turbine combustor according to this embodiment will be described, which are different from those according to the first embodiment.

The gas turbine combustor according to this embodiment includes the combustor liner 8 having an annular protruding portion 20*c* on the outer wall of the combustor liner 8. The annular protruding portion 20*c* has a curved surface at the downstream side in the flow direction of the compressed air 2. Preferably, the curved surface of the annular protruding portion 20*c* has a streamline shape. Preferably, the connection portion between the curved surface and the outer wall of the combustor liner 8 has a smooth curved shape and is smoothly connected with the outer wall of the combustor liner 8. More preferably, the connection portion has a streamline shape.

The thus configured gas turbine combustor of this embodiment is capable of suppressing increase in pressure loss caused by the downstream separation vortex 22*b* generated while the compressed air 2 flows along the annular protruding portion 20*c* and sufficiently offering an advantageous effect to enhance cooling by the convective heat transfer through reattachment of the downstream separation vortex 22*b*. Therefore, the gas turbine combustor of this embodiment can effectively attain both of enhancement of cooling of the combustor liner and suppression of increase in the pressure loss.

The annular protruding portion 20*c* may have a curved surface at the upstream side in the flow direction of the compressed air 2 as the annular protruding portion 20*b* in the third embodiment. That is, the annular protruding portion 20*c* may be configured to have both curved surfaces at the upstream side and the downstream side in the flow direction of the compressed air 2. This structure can attain both of enhancement of cooling of the combustor liner and suppression of increase in the pressure loss further effectively.

Fifth Embodiment

Figure 7:
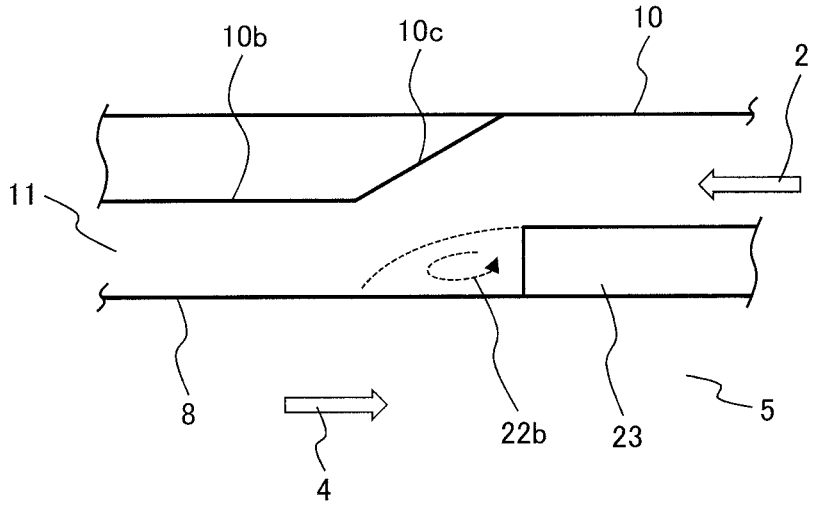
FIG. 7 is a schematic view of a part of the annular flow passage of the gas turbine combustor according to a fifth embodiment of the present invention, which is formed between the combustor liner and the flow sleeve.

FIG. 7 is a schematic view of a part of the annular flow passage 11 of the gas turbine combustor according to a fifth embodiment of the present invention, which is formed between the combustor liner 8 and the flow sleeve 10, illustrating a sectional view in parallel with the center axis of the gas turbine combustor. The features of the gas turbine combustor according to this embodiment will be described, which are different from those according to the first embodiment.

The combustor liner 8 of the gas turbine combustor according to this embodiment has a thick section 23 instead of the annular protruding portion 20 included in the gas turbine combustor according to the first embodiment. The position of the downstream side of the thick section 23 in the flow direction of the compressed air 2 is the same as the position of the downstream side of the annular protruding portion 20 in the flow direction of the compressed air 2 as described in the above embodiments. The position of the upstream side of the thick section 23 in the flow direction of the compressed air 2 is located at a connection portion between the combustor liner 8 and the transition piece 9. In other words, the thick section 23 is a member corresponding to the annular protruding portion 20 extending toward the upstream side of the flow direction in the compressed air 2 to the connection portion between the combustor liner 8 and the transition piece 9.

The thus configured gas turbine combustor according to this embodiment can reduce the retention region of the downstream separation vortex 22*b* generated while the compressed air 2 flows along the thick section 23 and sufficiently offering an advantageous effect to enhance cooling by the convective heat transfer through reattachment of the downstream separation vortex 22*b*. Therefore, the gas turbine combustor of this embodiment can effectively attain both of enhancement of cooling of the combustor liner and suppression of increase in the pressure loss. Further, the thick section 23 improves the buckling strength of the combustor liner 8 to increase the structural strength of the gas turbine combustor.

The thick section 23 may be formed so that the connection portion with the outer wall of the combustor liner 8 at the downstream side in the flow direction of the compressed air 2 has a smooth curved shape and is smoothly connected with the outer wall of the combustor liner 8 as the annular protruding portion 20*c* in the fourth embodiment. This structure can attain both of enhancement of cooling of the combustor liner and suppression of increase in the pressure loss further effectively.

Sixth Embodiment

Figure 8:
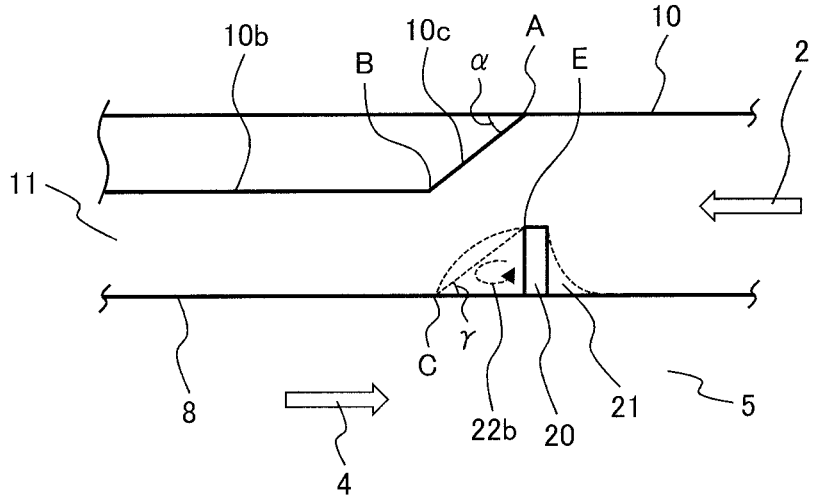
FIG. 8 is a schematic view of a part of the annular flow passage of the gas turbine combustor according to a sixth embodiment of the present invention, which is formed between the combustor liner and the flow sleeve.

FIG. 8 is a schematic view of a part of the annular flow passage 11 of the gas turbine combustor according to a sixth embodiment of the present invention, which is formed between the combustor liner 8 and the flow sleeve 10, illustrating a sectional view in parallel with the center axis of the gas turbine combustor. The features of the gas turbine combustor according to this embodiment will be described, which are different from those according to the first embodiment.

In this embodiment, a preferable value of the angle $\alpha$ (minor angle) will be described which is an angle formed between the internal-diameter changing portion 10*c* and the inner wall of the flow sleeve 10 of the gas turbine combustor. The preferable value of the angle $\alpha$ is 7° or larger as described below.

The typical length of the downstream separation vortex 22*b* generated by the annular protruding portion 20 in the flow direction of the compressed air 2 is 6 to 8 times longer than the height of the annular protruding portion 20. Assuming that the length of the downstream separation vortex 22*b* in the flow direction of the compressed air 2 is 8 times longer than the height of the annular protruding portion 20, the distance between the annular protruding portion 20 and the reattachment point C of the downstream separation vortex 22*b* is 8 times longer than the height of the annular protruding portion 20. Therefore, the angle $\gamma$ (minor angle) formed between the straight line connecting the position E of the top end portion of the annular protruding portion 20 with the reattachment point C and the outer wall of the liner 8 is arctan(⅛), namely, approximately 7°.

If the angle $\alpha$ is equal to or larger than the angle $\gamma$, namely, the angle $\alpha$ is 7° or more, the internal-diameter changing portion 10*c* can effectively change the direction of the flow of the compressed air 2 outside the downstream separation vortex 22*b* to a direction toward the liner 8. This change effectively reduces the length of the downstream separation vortex 22*b* in the flow direction of the compressed air 2. As a result, the retention region of the downstream separation vortex 22*b* is reduced to improve the advantageous effect to enhance cooling by the convective heat transfer through reattachment of the downstream separation vortex 22*b*.

Assuming that the length of the downstream separation vortex 22*b* in the flow direction of the compressed air 2 is 6 times longer than the height of the annular protruding portion 20, the angle $\gamma$ is arctan(⅙), namely, approximately 9°. Accordingly, setting of the angle $\alpha$ to 9° or larger may also provide the aforementioned effects.

As the angle $\alpha$ formed between the internal-diameter changing portion 10*c* and the inner wall of the flow sleeve 10 is larger, the effect for reducing the length of the downstream separation vortex 22*b* in the flow direction of the compressed air 2 is further improved. However, this may increase the pressure loss caused by the internal-diameter changing portion 10*c*. For this reason, it is preferable to adjust the angle $\alpha$ to an angle that can attain both of cooling of the combustor liner and suppression of increase in the pressure loss in accordance with the gas turbine combustor.

Seventh Embodiment

Figure 9:
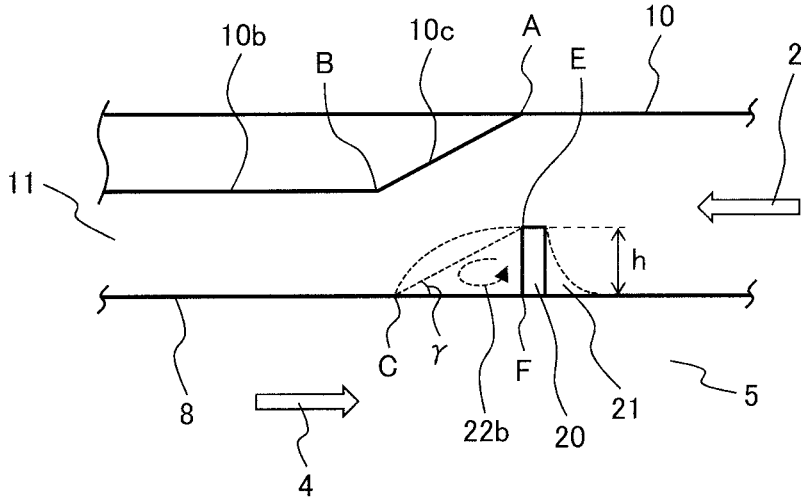
FIG. 9 is a schematic view of a part of the annular flow passage of the gas turbine combustor according to a seventh embodiment of the present invention, which is formed between the combustor liner and the flow sleeve.

FIG. 9 is a schematic view of a part of the annular flow passage 11 of the gas turbine combustor according to a seventh embodiment of the present invention, which is formed between the combustor liner 8 and the flow sleeve 10, illustrating a sectional view in parallel with the center axis of the gas turbine combustor. The features of the gas turbine combustor according to this embodiment will be described, which are different from those according to the first embodiment.

In this embodiment, a preferable position of the connection position B will be described, which is a connection position between the internal-diameter changing portion 10*c* and the internal-diameter reducing portion 10*b* of the flow sleeve 10 in the gas turbine combustor.

Preferably, the connection position B is located at the same position as the reattachment point C of the downstream separation vortex 22*b* or at a position downstream of the reattachment point C in the flow direction of the compressed air 2. Assuming, at the downstream side of the annular protruding portion 20 in the flow direction of the compressed air 2, that the connection position F is a connection position between the annular protruding portion 20 and the outer wall of the liner 8, that the angle $\gamma$ (minor angle) is an angle formed between the straight line connecting the position E of the top end portion of the annular protruding portion 20 with the reattachment point C of the downstream separation vortex 22*b* and the outer wall of the liner 8, and that the annular protruding portion 20 has the height h (protruding length), the distance between the position F and the reattachment point C is expressed as $h/\tan(\gamma)$. Accordingly, it is preferable to locate the connection position B downstream from the connection position F by the distance of $h/\tan(\gamma)$ or longer in the flow direction of the compressed air 2. In other words, it is preferable to locate the connection position B downstream from the connection position F between the annular protruding portion 20 at the downstream side and the outer wall of the liner 8 by the distance of $h/\tan(\gamma)$ or longer in the flow direction of the compressed air 2.

The position of the reattachment point C of the downstream separation vortex 22*b* may be obtained by the following method, for example. The heat transfer coefficient of the outer wall of the liner 8 is larger at the section where the downstream separation vortex 22*b* does not exist than at the section where the downstream separation vortex 22*b* exists. In other words, the temperature of the outer wall surface of the liner 8 sharply changes at the reattachment point C. Then the temperature measurement device such as a thermocouple device is used to measure the temperature of the outer wall surface of the liner 8 to determine a position at which the temperature sharply decreases (or a position at which the temperature is minimized). The thus determined position is set as the reattachment point C. It is also possible to determine the position of the reattachment point C by conducting the visualization test with Reynolds number adjusted in accordance with the actual device and visualizing the flow velocity vector through a flow visualization method, such as particle image velocimetry (PIV).

If the connection position B is located at the above determined position, the internal-diameter changing portion 10*c* can effectively change the direction of the flow of the compressed air 2 outside the downstream separation vortex 22*b* to a direction toward the liner 8. This change effectively reduces the length of the downstream separation vortex 22*b* in the flow direction of the compressed air 2. As a result, the retention region of the downstream separation vortex 22*b* is reduced to improve the advantageous effect to enhance cooling by the convective heat transfer through reattachment of the downstream separation vortex 22*b*.

Note that if the connection position B is located excessively away from the annular protruding portion 20 in the flow direction of the compressed air 2, the effect of the internal-diameter changing portion 10*c* may be weakened, which is an effect to reduce the length of the downstream separation vortex 22*b* in the flow direction of the compressed air 2. It is therefore preferable to determine the connection position B in consideration of the connection position A between the flow sleeve 10 and the internal-diameter changing portion 10*c* and the preferable value of the angle $\alpha$ described in the sixth embodiment.

Eighth Embodiment

Figure 10:
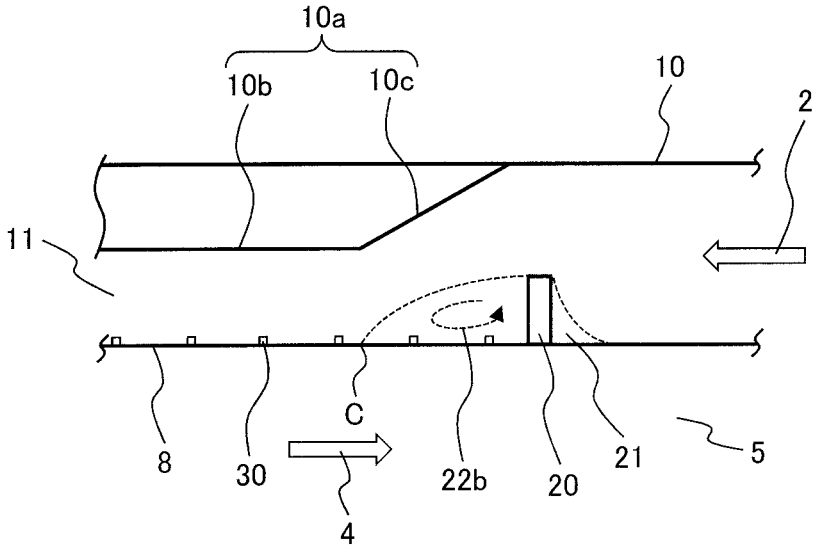
FIG. 10 is a schematic view of a part of the annular flow passage of the gas turbine combustor according to an eighth embodiment of the present invention, which is formed between the combustor liner and the flow sleeve.

FIG. 10 is a schematic view of a part of the annular flow passage 11 of the gas turbine combustor according to an eighth embodiment of the present invention, which is formed between the combustor liner 8 and the flow sleeve 10, illustrating a sectional view in parallel with the center axis of the gas turbine combustor. The features of the gas turbine combustor according to this embodiment will be described, which are different from those according to the first embodiment.

The gas turbine combustor according to this embodiment includes the combustor liner 8 having plural turbulators 30 at the downstream side of the annular protruding portion 20 in the flow direction of the compressed air 2. Each of the turbulators 30 is a rib which is disposed on the outer wall of the combustor liner 8 and protrudes toward the flow sleeve 10. The height (protruding length) of each of the turbulators 30 is smaller than that of the annular protruding portion 20 and is 1/20 to 1/50 of the width of the annular flow passage 11 (the distance between the combustor liner 8 and the flow sleeve 10). The most favorable interval between the turbulators 30 is approximately 10 times longer than the height of the turbulators 30. If the turbulators 30 are formed through machining to be integrated with the combustor liner 8, the heat transfer is enhanced by the fin effect, contributing to cooling of the liner 8.

The gas turbine combustor according to this embodiment is configured to enhance the effect for cooling the combustor liner 8 by the convective heat transfer through repetition of separation and reattachment of the vortex by the turbulators 30 at the downstream side of reattachment point C of the downstream separation vortex 22*b* generated by the annular protrusion portion 20 in the flow direction of the compressed air 2 before redevelopment of the boundary layer that has been destroyed by the reattachment of the downstream separation vortex 22*b*. In addition, if the turbulators 30 are integrated with the combustor liner 8, the turbulators 30 enlarge the heat transfer area by the fin effect even in the region where the downstream separation vortex 22*b* exists, further enhancing cooling of the combustor liner 8.

Ninth Embodiment

Figure 11A:
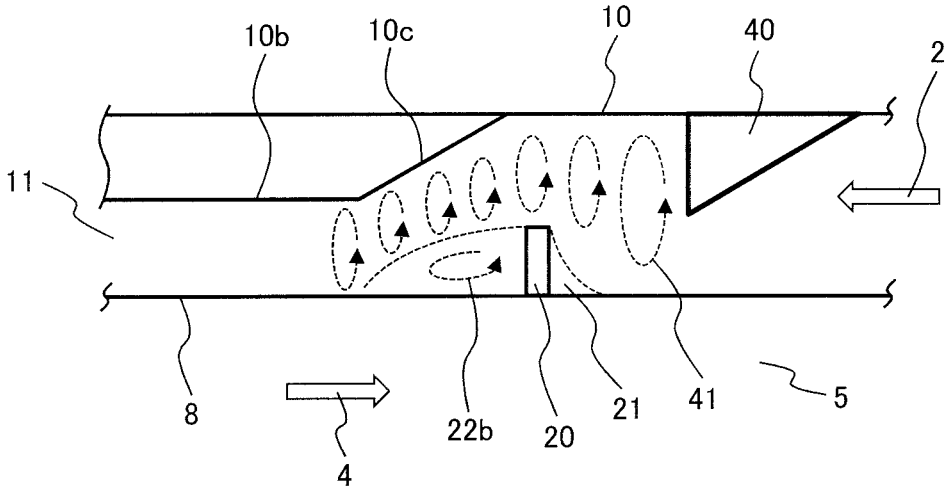
FIG. 11A is a schematic view of a part of the annular flow passage of the gas turbine combustor according to a ninth embodiment of the present invention, which is formed between the combustor liner and the flow sleeve, as a sectional view in parallel with a center axis of the gas turbine combustor.
Figure 11B:
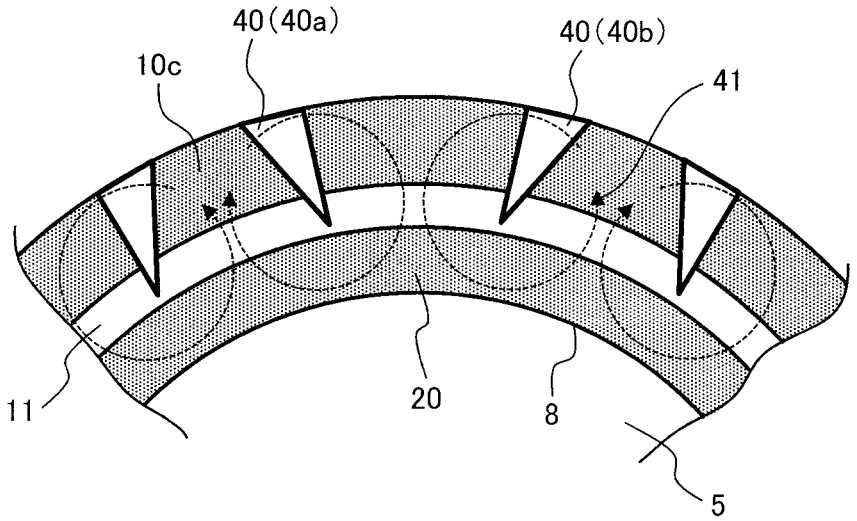
FIG. 11B is a schematic view of a part of the annular flow passage of the gas turbine combustor according to the ninth embodiment of the present invention, which is formed between the combustor liner and the flow sleeve, as a sectional view perpendicular to the center axis of the gas turbine combustor.

Referring to FIGS. 11A and 11B, the gas turbine combustor according to a ninth embodiment of the present invention will be described. FIGS. 11A and 11B are schematic views of a part of the annular flow passage 11 of the gas turbine combustor according to the ninth embodiment of the present invention, which is formed between the combustor liner 8 and the flow sleeve 10. FIG. 11A is a sectional view of the gas turbine combustor in parallel with the center axis of the gas turbine combustor. FIG. 11B is a sectional view of the gas turbine combustor perpendicular to the center axis of the gas turbine combustor, a view of the internal-diameter changing portion 10*c* and the annular protruding portion 20 when seen from the upstream side in the flow direction of the compressed air 2. The features of the gas turbine combustor according to this embodiment will be described, which are different from those according to the first embodiment.

The gas turbine combustor according to this embodiment includes the flow sleeve 10 having plural longitudinal vortex generators 40 upstream of the internal-diameter changing portion 10*c* and the annular protruding portion 20 in the flow direction of the compressed air 2. Each of the longitudinal vortex generators 40 is formed on the inner wall of the flow sleeve 10, protruding toward the combustor liner 8, and fixed to the surface of the inner wall of the flow sleeve 10 by welding or spot welding, for example. Each of the longitudinal vortex generators 40 generates a longitudinal vortex 41 with the center axis of rotation in the flow direction of the compressed air 2.

As FIG. 11B shows, two adjacent longitudinal vortex generators 40 are paired with each other. The paired longitudinal vortex generators 40 (40*a*, 40*b*) protrude toward the combustor liner 8 with approaching each other. In other words, the paired longitudinal vortex generators 40 (40*a*, 40*b*) are formed on the flow sleeve 10 to have angles so that the generated longitudinal vortices 41 have reversed rotating directions with each other.

When the paired longitudinal vortex generators 40 are formed on the flow sleeve 10 and arranged to generate adjacent longitudinal vortices 41 having reversed rotating directions with each other, the longitudinal vortices 41 can be efficiently generated and maintained because the adjacent longitudinal vortices 41 interact with each other. It is therefore possible to perform sufficient cooling with small pressure loss and to suppress increase in the pressure loss with improving the product reliability.

Each of the longitudinal vortices 41 generated by the longitudinal vortex generators 40 has a reduced radius to have a reinforced vorticity resulting from narrowing of the annular flow passage 11 by the annular protruding portion 20 on the combustor liner 8, and has a changed traveling direction toward the combustor liner 8 by the internal-diameter changing portion 10*c*. As a result, the inside of the annular flow passage 11 is agitated in the region close to the wall surface of the combustor liner 8 to enhance the heat transfer around the wall surface of the combustor liner 8 with suppressing increase in the pressure loss. The length of the downstream separation vortex 22*b* generated by the annular protruding portion 20 is effectively reduced in the flow direction of the compressed air 2 to improve the effect to enhance the cooling by the convective heat transfer through reattachment of the downstream separation vortex 22*b*.

When the height (protruding length) of each of the longitudinal vortex generators 40 is increased so that the longitudinal vortex 41 reaches the outer wall of the combustor liner 8, such effects are obtained as agitating the whole inside of the annular flow passage 11 and agitating the temperature boundary layer at the side of the combustor liner 8. These effects lead to further enhancement of the heat transfer on the outer wall surface of the combustor liner 8, more effectively enhancing cooling of the combustor liner 8.

EXPLANATION OF REFERENCE CHARACTERS

1: compressor, 2: compressed air, 2*b*, 2*c*: flow velocity vector, 3: gas turbine, 4: combustion gas, 5: combustion chamber, 6: gas turbine combustor, 7: generator, 8: combustor liner, 9: transition piece, 10: flow sleeve, 10*a*: narrowing member, 10*b*: internal-diameter reducing portion, 10*c*: internal-diameter changing portion, 10*d*: downstream internal-diameter changing portion, 10*e*: connection portion between internal-diameter changing portion and internal-diameter reducing portion, 10*f*: connection portion between internal-diameter changing portion and flow sleeve, 11: annular flow passage, 12: plate, 13: burner, 20, 20*b*, 20*c*: annular protruding portion, 21: upstream separation vortex, 22*a*, 22*b*: downstream separation vortex, 23: thick portion, 30: turbulators, 40, 40*a*, 40*b*: longitudinal vortex generators, 41: longitudinal vortex.

What is claimed is:

1. A gas turbine combustor comprising:

a combustor liner as an inner duct in which a combustion chamber is formed;

a plurality of burners facing the combustion chamber;

a transition piece, as a tail duct, which is connected to the combustor liner;

a flow sleeve, as an outer duct, in which the combustor liner, the burners, and the transition piece are provided; and an annular flow passage formed between the transition piece and the flow sleeve, between the combustor liner and the flow sleeve, and between the burners and the flow sleeve, through which compressed air, to be supplied to the burners for generating combustion gas, flows, wherein a narrowing member is attached to an inner wall of the flow sleeve, the narrowing member protruding in the annular flow passage toward the combustor liner;

the combustor liner includes an annular protruding portion annularly formed on an outer wall of the combustor liner, the annular protruding portion protruding toward the flow sleeve;

the narrowing member includes an internal-diameter changing portion, an internal-diameter reducing portion, and a downstream internal-diameter changing portion;

the internal-diameter changing portion is diagonally connected to the flow sleeve to gradually approach the combustor liner as the internal-diameter changing portion extends in a flow direction of the compressed air;

the internal-diameter reducing portion is disposed at a downstream side of the internal-diameter changing portion in the flow direction of the compressed air, connected to the internal-diameter changing portion, and extending along the flow direction of the compressed air;

the downstream internal-diameter changing portion is disposed at a downstream side of the internal-diameter reducing portion in the flow direction of the compressed air, connected to the internal-diameter reducing portion, and diagonally connected to the flow sleeve to gradually recede away from the combustor liner as the downstream internal-diameter changing portion extends in the flow direction of the compressed air;

the internal-diameter changing portion is a first surface and a cross-section of the first surface taken along a plane crossing through the flow sleeve is a first straight line, the internal-diameter reducing portion is a second surface and a cross-section of the second surface taken along the plane crossing through the flow sleeve is a second straight line, and the annular protruding portion is located at a position on the outer wall of the combustor liner, the position facing a connection position between the flow sleeve and the internal-diameter changing portion or being at an upstream side of the position facing the connection position in the flow direction of the compressed air.

2. The gas turbine combustor according to claim 1, wherein the internal-diameter changing portion has a curved connection portion with the flow sleeve and has a curved connection portion with the internal-diameter reducing portion.

3. The gas turbine combustor according to claim 1, wherein the annular protruding portion has a curved surface at an upstream side in the flow direction of the compressed air.

4. The gas turbine combustor according to claim 1, wherein the annular protruding portion has a curved surface at a downstream side in the flow direction of the compressed air.

5. The gas turbine combustor according to claim 1, wherein the transition piece is connected to the combustor liner at an upstream side of the combustor liner in the flow direction of the compressed air, wherein the annular protruding portion extends to a connection portion between the combustor liner and the transition piece.

6. The gas turbine combustor according to claim 1, wherein the internal-diameter changing portion is connected to the flow sleeve at an angle of 7° or more.

7. The gas turbine combustor according to claim 1, wherein, a position of the combustor liner facing a connection position between the internal-diameter changing portion and the internal-diameter reducing portion is a position D and a position of a top end portion of the annular protruding portion at a downstream side in the flow direction of the compressed air is a position E, the annular protruding portion has a protruding length toward the flow sleeve, the protruding length is a length such that an angle formed between a straight line connecting the position D with the position E and the combustor liner is equal to or smaller than an angle formed between the internal-diameter changing portion and the flow sleeve.

8. The gas turbine combustor according to claim 1, wherein, the annular protruding portion has a protruding length h toward the flow sleeve, a position of a top end portion of the annular protruding portion at a downstream side in the flow direction of the compressed air is a position E, and an angle formed between a straight line connecting the position E with a reattachment point C of a downstream separation vortex generated by the annular protruding portion and the combustor liner is γ, a connection position between the internal-diameter changing portion and the internal-diameter reducing portion is located at a position downstream in the flow direction of the compressed air from a connection position between the annular protruding portion at the downstream side and the combustor liner by a distance of h/tan(γ) or longer.

9. The gas turbine combustor according to claim 1, wherein the combustor liner further includes a plurality of turbulators formed on the outer wall of the combustor liner, the turbulators protruding toward the flow sleeve; and the turbulators are located at a downstream side of the annular protruding portion in the flow direction of the compressed air, having a protruding length toward the flow sleeve smaller than a protruding length of the annular protruding portion toward the flow sleeve.

10. The gas turbine combustor according to claim 1, wherein the flow sleeve further includes a plurality of longitudinal vortex generators formed on the inner wall of the flow sleeve, each of the longitudinal vortex generators protruding toward the combustor liner and generating a longitudinal vortex having a center axis of rotation in the flow direction of the compressed air; and the longitudinal vortex generators are disposed at an upstream side of the internal-diameter changing portion and the annular protruding portion in the flow direction of the compressed air.

11. The gas turbine combustor according to claim 1, wherein the downstream internal-diameter changing portion is a third surface and a cross-section of the third surface taken along the plane crossing through the flow sleeve is a third straight line.

12. The gas turbine combustor according to claim 1, wherein the transition piece is connected to the combustor liner at an upstream side of the combustor liner in the flow direction of the compressed air, and the transition piece is connected to the combustor liner to guide combustion gas away from the combustion chamber.

* * * * *